United States Patent [19]

Jacobs et al.

[11] 4,011,480

[45] Mar. 8, 1977

[54] ELECTRIC DISCHARGE LAMP

[75] Inventors: Cornelis Adrianus Joannes Jacobs; Bart van der Leeuw, both of Eindhoven, Netherlands

[73] Assignee: U.S. Philips Corporation, New York, N.Y.

[22] Filed: Oct. 29, 1975

[21] Appl. No.: 626,611

[30] Foreign Application Priority Data

Nov. 14, 1974 Netherlands ..... 7414846

[52] U.S. Cl. ..... 313/217; 313/285; 313/331

[51] Int. Cl.[2] ..... H01J 61/06

[58] Field of Search ..... 313/217, 331, 285

[56] References Cited

UNITED STATES PATENTS 3,965,383 6/1976 List et al. ..... 313/331

*Primary Examiner*—R. V. Rolinec
*Assistant Examiner*—Darwin R. Hostetter
*Attorney, Agent, or Firm*—Frank R. Trifari; Robert S. Smith

[57] ABSTRACT

The tubular ceramic discharge vessel of electric discharge lamps is sealed according to the invention with a cylindrical and an annular ceramic moulding between which a tubular current leadthrough member is accommodated consisting of tungsten, molybdenum, rhenium or alloys thereof. The current leadthrough member is connected in a vacuum-tight manner to the two ceramic mouldings by means of sealing ceramic.

9 Claims, 4 Drawing Figures

ELECTRIC DISCHARGE LAMP

The invention relates to an electric discharge lamp having a tubular discharge vessel of ceramic which is sealed by means of an annular and a cylindrical ceramic moulding between which a tubular metal current lead-through member is accommodated.

In discharge lamps which have a high operating temperature — for example, 1000° C or higher — the discharge vessel consists of ceramic material which is to be understood to mean herein both polycrystalline material and translucent, gas-tight $Al_2O_3$, $MgAl_2O_4$ (Spinel) and $Y_2O_3$, and also monocrystalline material, such as sapphire.

In contrast with glass, said material cannot be deformed at higher temperatures. Consequently, ceramic discharge tubes are usually sealed with ceramic mouldings which are secured to the wall of the tube in a vacuum-tight manner by means of sealing ceramic (published German Patent Application 1,471,379).

Ceramic mouldings can also be secured in a vacuum-tight manner to the wall of the tube by shrinking them around or in the tube (U.S. Pat. No. 3,564,328).

Current leadthrough members are incorporated in the mouldings and consist preferably of a metal having a coefficient of linear expansion which is equal to that of the ceramic material or deviates only little therefrom. As such is to be considered niobium, but also tantalum (above-mentioned publications).

However, both said metals are expensive and have the additional drawback of not withstanding halogenides and oxygen, which property adversely influences the life of lamps in which said metals contact the said materials.

From United Kingdom Patent Specification 1,152,134 an electric discharge lamp of the kind mentioned in the preamble is known in which the current leadthrough member at its surface consists of a metal having a coefficient of linear expansion which is higher than that of the ceramic material and which is chosen from the group consisting of platinum, iron, nickel and cobalt. The core of the member consists of an alloy the coefficient of linear expansion of which corresponds to that of the ceramic.

According to said Patent Specification, current leadthrough member and ceramic mouldings are connected together in a vacuum-tight manner by a treatment under pressure and at high temperature in a dry hydrogen atmosphere.

The lamp according to said United Kingdom Patent Specification suffers from the drawback that its manufacture is time-consuming and that special tools are necessary to exert pressure on the ceramic mouldings and the current leadthrough member during the process in which said parts are connected.

It is known from published German Patent Application 2,032,277 that metals having a considerably lower coefficient of expansion than the ceramic, for example, tungsten, molybdenum, rhenium and alloys thereof, may be used for the current leadthrough member. These metals can withstand the aggressive materials present in discharge lamps.

According to said Patent Application, a number of layers having coefficients of expansion increasing from layer to layer from within to without are provided under pressure between the current leadthrough member and the ceramic moulding, said layers being provided so as to bridge the difference in coefficients of expansion between the current leadthrough member and the moulding.

The advantages of this proposal, the use of cheap and resistant materials, are nullified by the complicated manufacture of lamps having such a construction.

It is an object of the invention to provide a discharge lamp having a simple construction of the discharge vessel seal and a current leadthrough of resistant metal.

In agreement herewith, the invention relates to an electric discharge lamp of the kind mentioned in the preamble which is characterized in that the current leadthrough member consists of a metal chosen from the group consisting of tungsten, molybdenum, rhenium and alloys thereof and that said member is connected in a vacuum-tight manner to the two ceramic mouldings by means of sealing ceramic.

It has surprisingly been found that a vacuum-tight seal of a discharge vessel in the lamp according to the invention is ensured also when the current leadthrough member is a tube having a comparatively large wall thickness. In general the wall thickness of the tube will be from 20 to 250 $\mu$m, as a rule from 20 to 150 $\mu$m. In general there will be no need for choosing a tube having a thicker wall, since tubes having the above wall thickness already have amply sufficient conductivity.

The tubes used can be obtained by extrusion, deep drawing or rolling sheet material, in which latter case substantially closed tubes are obtained which also prove to give perfect satisfaction.

It is to be noted that Dutch non-prepublished Patent Application 7,311,290 describes an electric discharge lamp in which the current leadthrough member consists of a number of molybdenum foil strips of a small thickness (approximately 15 $\mu$m) which are clamped between the wall of the cylindrical discharge vessel and the moulding with which the vessel is sealed.

The advantage of the lamp according to the invention is that — since the current leadthrough member in this case is a tube and the tube wall may be much thicker than the said foil strips — the current leadthrough member has a much lower electric resistance and upon passage of current will hence reach a much lower temperature. Another advantage is that the current leadthrough member according to the invention is mechanically stronger and is excellently suitable as a support for an electrode. A further advantage of a tube is that no geometric discontinuities are present where stresses concentrate.

The current leadthrough member may have a variety of dimensions. The outer diameter of the current leadthrough member is preferably chosen to be so that the inner diameter of the discharge vessel is 1.5 to 10 times larger and in a preferred embodiment is 2 to 5 times larger.

The annular and the cylindrical moulding are proportioned so that the sealing ceramic can fill the spaces between current leadthrough member and mouldings by capillary action.

In or at the end of the current leadthrough member extending in the lamp vessel, a supporting member may be provided for the electrode and be secured thereto by a welded joint. In a preferred embodiment the current leadthrough member is constructed as a cylindrical tube closed at the end extending in the lamp vessel and the end wall serves as a supporting member.

In a further preferred embodiment the end of the current leadthrough member projecting in the lamp vessel or the supporting member is locally perforated. As a result of this the sealing ceramic can more easily fill the capillary spaces between the current leadthrough member and the cylindrical moulding during the manufacture of the lamp.

In a further preferred embodiment the cylindrical moulding is perforated, preferably centrally, so that the current leadthrough member can serve as an exhaust tube during the manufacture of the lamp. In that case the lamp vessel is sealed by pinching and/or welding the current leadthrough member outside the lamp envelope, but preferably by filling the aperture in the moulding with sealing ceramic.

The annular ceramic moulding may be shrink-fitted in a vacuum-tight manner to the wall of the cylindrical discharge vessel. Another possibility is that both parts are connected by means of sealing ceramic.

The annular moulding may comprise an aperture through which an auxiliary electrode is inserted into the lamp vessel, the leadthrough being sealed with sealing ceramic.

As a sealing ceramic may be used inter alia the known materials which can withstand the fillings of discharge lamps, for example, those known from the U.S. Pat. Nos. 3,281,309, 3,441,421, 3,588,577 and those from the above-mentioned Patent publications.

The invention will be described in greater detail with reference to a drawing. In the drawing.

Figure 1:
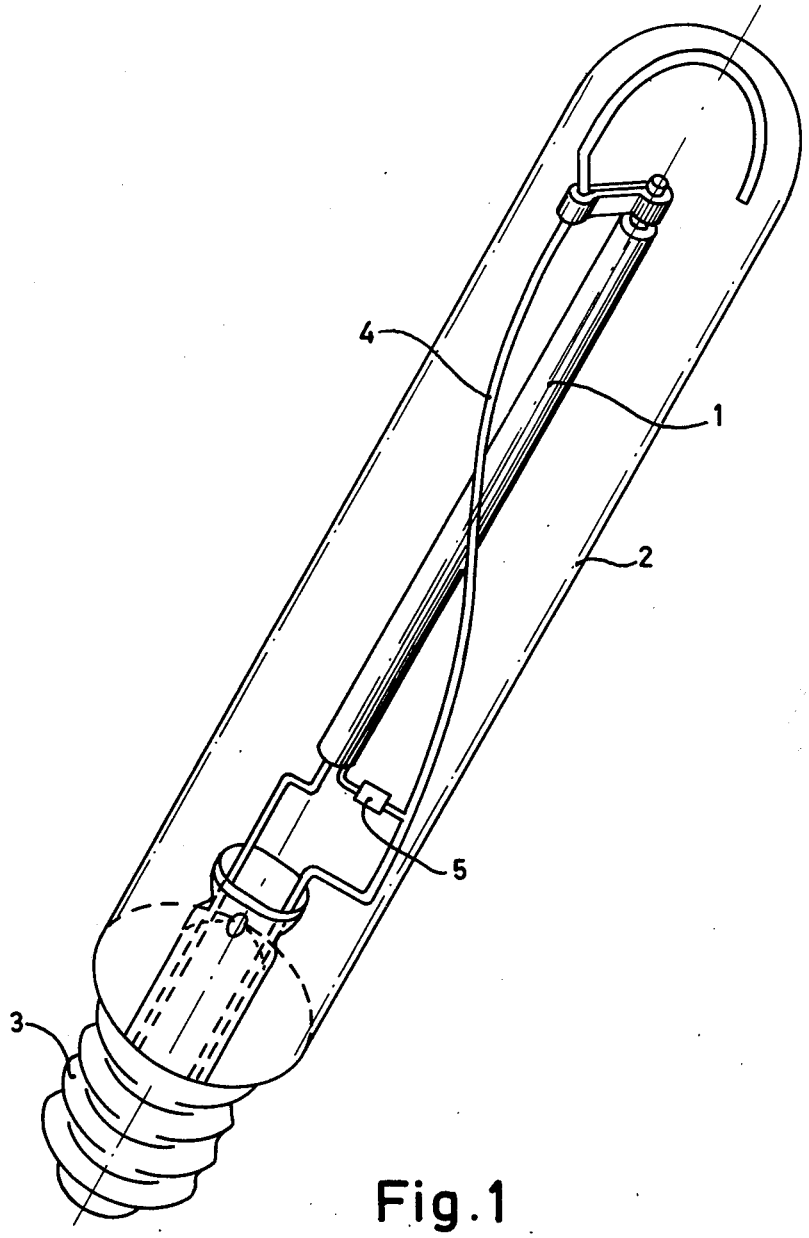
FIG. 1 shows a discharge lamp according to the invention.

Reference numeral 1 in FIG. 1 denotes a discharge tube of a high pressure sodium vapour discharge lamp of 400 Watt. 2 denotes the outer envelope of said discharge lamp. 3 denotes the lamp cap. 4 is a pole wire. A resistor 5 is also connected to the pole wire. The other end of said resistor is connected to an internal auxiliary electrode (see 20 in FIG. 3) in the discharge tube 1.

Figure 2:
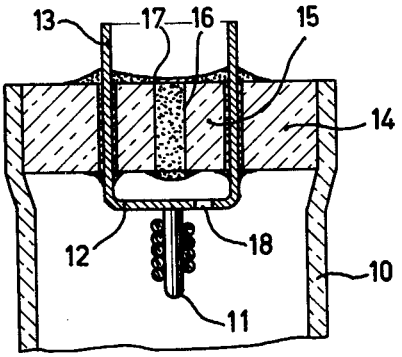
FIGS. 2 through 4 are longitudinal sectional views through one end of a discharge vessel.

Reference numeral 10 in FIG. 2 denotes a part of the discharge tube 1 shown in FIG. 1. Said discharge tube is made of translucent gas-tight aluminium oxide. The filling of the tube consists of an amalgam, notably a combination of sodium and mercury, and comprises an ignition gas, for example, xenon. 11 denotes a main electrode which is secured to a tubular current leadthrough member 13 of tungsten via a supporting member 12. The current leadthrough member 13 is connected to the ceramic mouldings 14 and 15, likewise consisting of translucent sintered aluminium oxide, by means of a sealing ceramic 17. The sealing ceramic in this case consists of a mixture of 30% by weight of $Al_2O_3$, 30% by weight of BaO, 40% by weight of $B_2O_3$ having a melting point of approximately 1400° C. 16 is a central aperture in the cylindrical moulding 15 and 18 is an aperture in the supporting member 12 which forms one assembly with current leadthrough member 13. The aperture 16 is also sealed with sealing ceramic.

Figure 3:
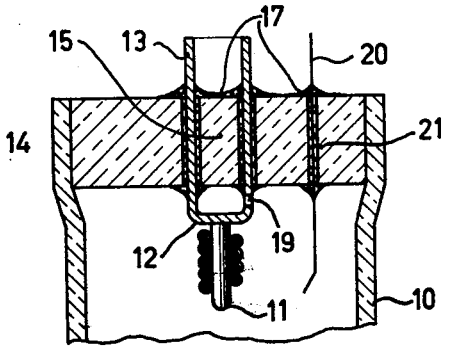

The reference numerals in FIG. 3 denote the same parts as in FIG. 2. 19 is an aperture in the current leadthrough member 13, while 20 denotes an auxiliary electrode which is inserted into the lamp vessel through an aperture 21.

Figure 4:
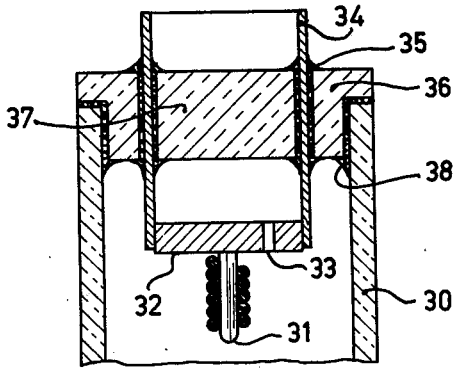

In FIG. 4 an electrode 31 of tungsten is welded to a tungsten supporting member 32 which has an aperture 33. The supporting member is connected to the current leadthrough member 34 of molybdenum which is connected to the ceramic mouldings 36 and 37 by means of sealing ceramic 35. The annular ceramic moulding 36 is connected to the wall 30 of the tubular discharge vessel by means of sealing ceramic 38.

In a concrete case the length of the discharge vessel of sintered $Al_2O_3$ (10 in FIG. 3) was 11 cm, the outer diameter was 1 cm and the wall thickness was 0.1 cm. The ceramic mouldings, likewise of sintered $Al_2O_3$, had a thickness of 0.3 cm. Prior to assembly, the annular mouldings 14 were prefired to a higher temperature than the tube 10. The two ends of the tube 11 were provided with an annular moulding 14, after which rigid connections were obtained by heating at 1850° C in a hydrogen atmosphere as a result of the difference in shrinkage between the rings and the tube. A molybdenum tube 13, outside diameter 0.4 cm, wall thickness 150 $\mu$, having the tungsten electrode 11 was inserted into the large aperture in one of mouldings 14 which was approximately 200 $\mu$m larger than the diameter of the tube. A cylinder 15 of $Al_2O_3$ sintered at 1850° C was introduced into the tube and had an amount of play of approximately 25 $\mu$m. A tungsten auxiliary electrode 20, diameter 60 $\mu$m, was inserted into a second aperture 21 in the moulding 14 of 100 $\mu$m. Sealing ceramic was provided around the apertures to be sealed in the mouldings: 44% by weight of $Al_2O_3$, 38% by weight of CaO, 9% by weight of BaO, 6% by weight of MgO, 2% by weight of $B_2O_3$ and 1% by weight of $SiO_2$. Heating was then carried out in a vacuum up to a temperature of approximately 1450° C.

The tube which was sealed at one end was then rinsed with argon, provided with mercury, sodium iodide, thallium iodide and indium iodide and then provided at the other end with current leadthrough member 13 and electrode 11 provided thereon. While cooling the ready end of the discharge vessel, the other end was sealed in an atmosphere of 20 Torr by means of sealing ceramic.

What is claimed is:

1. An electric discharge lamp having a tubular discharge vessel of ceramic which is sealed by means of an annular and a cylindrical ceramic moulding between which a tubular metal current leadthrough member is accommodated, characterized in that the current leadthrough member consists of a metal chosen from the group consisting of tungsten, molybdenum, rhenium and alloys thereof, and that said member is connected in a vacuum-tight manner to the two ceramic mouldings by means of sealing ceramic.

2. An electric discharge lamp as claimed in claim 1, characterized in that the current leadthrough member has a wall thickness of 20 to 250 $\mu$m.

3. An electric discharge lamp as claimed in claim 2, characterized in that the current leadthrough member has a wall thickness of 20 to 150 $\mu$m.

4. An electric discharge lamp as claimed in claim 1 characterized in that the inner diameter of the cylindrical discharge vessel is 1.5 to 10 times larger than the outer diameter of the current leadthrough member.

5. An electric discharge lamp as claimed in claim 4, characterized in that the inner diameter of the cylindrical discharge vessel is 2–5 times larger than the outer diameter of the current leadthrough member.

6. An electric discharge lamp as claimed in claim 4, characterized in that the current leadthrough member is a tube closed at the end extending in the lamp vessel.

7. An electric discharge lamp as claimed in claim 6, characterized in that the end of the current leadthrough member extending in the lamp vessel is locally perforated.

8. An electric discharge lamp as claimed in claim 7, characterized in that the cylindrical ceramic moulding is perforated centrally.

9. An electric discharge lamp as claimed in claim 8, characterized in that the aperture in the cylindrical ceramic moulding is sealed by means of sealing ceramic.

* * * * *